US007037031B2

(12) United States Patent
Haynie

(10) Patent No.: US 7,037,031 B2
(45) Date of Patent: May 2, 2006

(54) AUTOMATIC BARRICADE FOR LOW WATER CROSSINGS

(76) Inventor: Mark D. Haynie, 2410 Welsch La., New Braunfels, TX (US) 78132

( * ) Notice: Subject to any disclaimer, the term of this patent is extended or adjusted under 35 U.S.C. 154(b) by 3 days.

(21) Appl. No.: 11/106,815

(22) Filed: Apr. 15, 2005

(65) Prior Publication Data

US 2005/0196234 A1 Sep. 8, 2005

Related U.S. Application Data

(63) Continuation-in-part of application No. 10/769,454, filed on Jan. 30, 2004, now abandoned.

(60) Provisional application No. 60/444,412, filed on Feb. 3, 2003.

(51) Int. Cl.
*E01F 13/08* (2006.01)

(52) U.S. Cl. ..... 404/6; 404/9; 256/13; 256/13.1; 116/63 R; 116/228; 49/49; 49/131

(58) Field of Classification Search ..... 404/6, 404/9, 10; 256/1, 13, 13.1; 405/92, 96; 116/63 R, 228; 49/49, 131
See application file for complete search history.

(56) References Cited

U.S. PATENT DOCUMENTS

| | | | | |
|---|---|---|---|---|
| 1,170,545 | A | 2/1916 | Keenan | |
| 1,203,006 | A | 10/1916 | Keenan | |
| 1,267,061 | A * | 5/1918 | Meyer | 73/319 |
| 1,694,754 | A | 12/1928 | Peppin | |
| 1,790,602 | A | 1/1931 | Siefker | |
| 2,325,260 | A | 7/1943 | May | |
| 2,607,835 | A | 8/1952 | Bonar | |
| 3,926,143 | A * | 12/1975 | Hothan | 116/228 |
| 4,377,352 | A | 3/1983 | Goodstein | |
| 4,577,991 | A * | 3/1986 | Rolow | 404/6 |
| 4,879,545 | A | 11/1989 | Aguilar | |
| 4,922,655 | A * | 5/1990 | Seal | 49/131 |
| 5,322,385 | A | 6/1994 | Reisman | |
| 5,460,462 | A * | 10/1995 | Regan | 405/96 |
| 5,862,775 | A | 1/1999 | Stroud | |
| 6,158,696 | A | 12/2000 | Brodskiy | |
| 6,224,291 | B1 * | 5/2001 | Mateychuk | 404/6 |
| 6,474,903 | B1 | 11/2002 | Marts | |
| 6,623,209 | B1 | 9/2003 | Waters | |
| 6,623,210 | B1 * | 9/2003 | Nomura et al. | 405/107 |
| 6,732,479 | B1 * | 5/2004 | Nomura et al. | 52/64 |

FOREIGN PATENT DOCUMENTS

| | | |
|---|---|---|
| FR | 2 665 465 | 8/1990 |
| FR | 2 731 726 | 3/1995 |

* cited by examiner

*Primary Examiner*—Gary S. Hartmann
(74) *Attorney, Agent, or Firm*—G. Turner Moller

(57) ABSTRACT

An automatic barricade includes a trench across a road that is covered by a grate allowing vehicular traffic during normal dry weather. Inside the trench is a series of barricade elements, each of which includes a float. When rising water fills the trench to a predetermined level, each float rises and elevates the elements above the road. The barricade elements are sufficiently robust and intimidating to deter motorists from driving over them but are spaced apart to be light enough to be easily actuated by the float. The barricade elements are sufficiently close together that vehicles cannot pass between them. In another embodiment, a sensor is adjacent the trench to detect rising water and communicates with a motor connected to the barricade elements for raising them to a traffic blocking position.

19 Claims, 6 Drawing Sheets

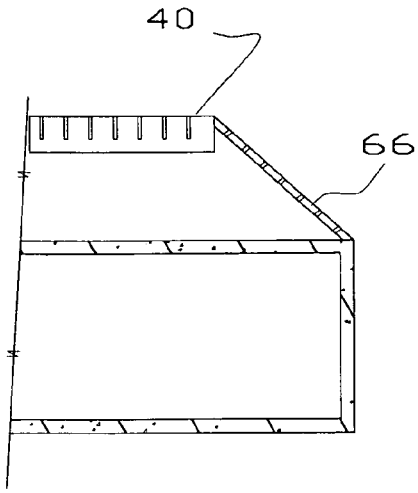
Fig.5
Fig.6
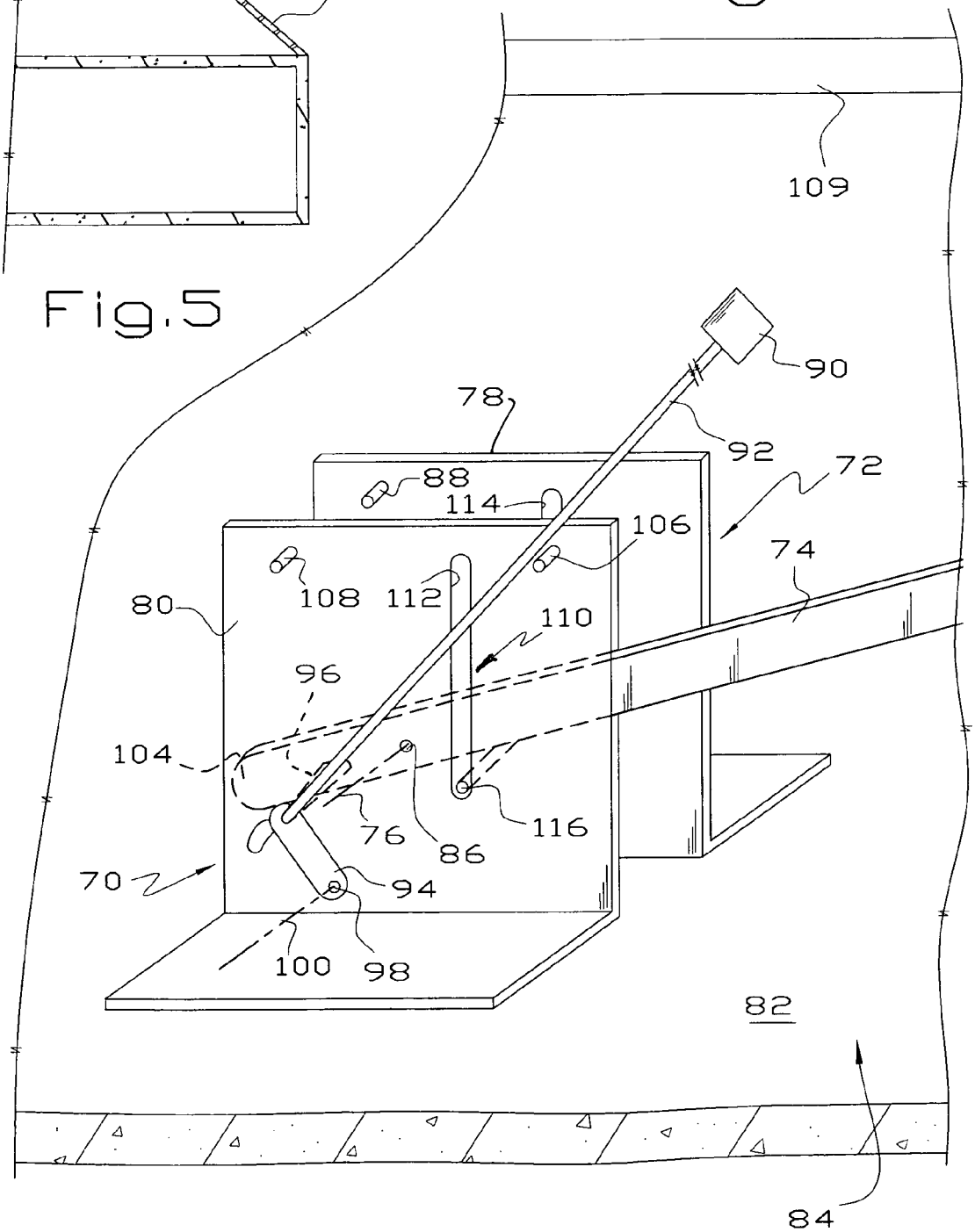

AUTOMATIC BARRICADE FOR LOW WATER CROSSINGS

RELATED APPLICATIONS

This application is based on provisional application Ser. No. 60/444,412, filed Feb. 3, 2003, entitled AUTOMATIC BARRICADES FOR LOW WATER CROSSINGS, and is a continuation-in-part of application Ser. No. 10/769,454, filed Jan. 30, 2004, now abandoned originally entitled AUTOMATIC BARRICADES FOR LOW WATER CROSSINGS.

This invention relates to a barricade across a road at a location adjacent a low water crossing to deter motorists from driving through rising flood water, and more particularly to a barricade that is automatically elevated by rising water.

BACKGROUND OF THE INVENTION

It is well known that vehicle drivers frequently underestimate the force of water flowing across a low water crossing. During floods, news reports are replete with situations where otherwise rational people drive across a low water crossing only to be stranded in the road or swept downstream by flowing water. Sometimes these situations end in disaster, sometimes rescue personnel risk their safety and lives to rescue the drivers and occupants of vehicles.

Governmental authorities in flood prone areas have typically responded to this situation by sending police or firemen to place standard traffic barricades in the road adjacent low water crossings. These barricades must be placed in a timely manner at appropriate locations, must be sufficient in size and placement to deter motorists and must be monitored to prevent the barricades from being moved or removed by motorists or flood water.

The failures of current techniques are in categories that match up with the requirements of effective barricades, i.e. they are not placed in a timely manner, they are not placed at appropriate low water crossings or are inappropriately positioned at proper low water crossings, motorists drive around or move barricades and flood waters turn barricades over or sweep them downstream. There is accordingly no dispute that current techniques are inadequate, the most persuasive evidence being motorists stranded in the road or swept downstream during floods.

There are many types of indicators or alarms that have been proposed or used to show attentive motorists that water has risen and by how much. The simplest and most widely used is a piece of pipe embedded in the ground near a low water crossing with marks on the pipe showing the height of water flowing over the road. A number of proposals have been made for alarms or indicators placed on the side of the road, which are actuated by rising water, to indicate that the water height is dangerous such as shown in U.S. Pat. Nos. 2,607,835 and 4,879,545. Other disclosures of interest are found in U.S. Pat. Nos. 4,377,352; 5,460,462; 5,862,775 and 6,623,209.

SUMMARY OF THE INVENTION

In this invention, an automatic barricade is placed across a road adjacent a low water crossing. The barricade is placed in a trench dug across the road at an elevation where the water level is sufficient to activate the barricade and raise it to a position blocking traffic from proceeding along the road. Thus, rising water fills the trench sufficient to raise the barricade and empties when water levels decline so the barricade lies down in the trench. The trench is covered by a grate which allows traffic to drive across the trench in normal dry conditions. If experience dictates that water rises a substantial distance during floods at a particular low water crossing, additional automatic barricades are preferably placed at different elevations spaced in the direction of travel.

The barricade is preferably actuated by a series of floats operably connected to each of a series of spaced apart barricade elements. The barricade elements are sufficiently intimidating to deter a motorist from driving over them, are spaced close enough together that a motorist cannot drive between them and are sufficiently light to be easily raised by rising water acting on the float.

In another embodiment, a sensor in or adjacent the trench detects rising water and delivers an output signal that operates a mechanism to raise the barricade elements.

It is an object of this invention to provide an automatic barricade placed across a road adjacent a low water crossing.

A further object of this invention is to provide an automatic barricade which is sufficient to deter motorists from attempting to cross a low water crossing in times of flood.

Another object of this invention is to provide an automatic barricade that does not require human intervention in the activation of the barricade and which does not require monitoring during times of flood.

A more specific object of this invention is to provide an automatic barricade placed across a road that is raised and lowered by a float inside a trench which houses the barricade.

Another more specific object of this invention is to provide an automatic barricade placed across a road that is raised and lowered in response to a sensor detecting rising water adjacent the barricade.

These and other objects and advantages of this invention will become more apparent as this description proceeds, reference being made to the accompanying drawings and appended claims.

BRIEF DESCRIPTION OF THE DRAWINGS

FIG. 5 is a view of the open end of the trench of the barricade of this invention;

FIG. 6 is a broken isometric view of a more sophisticated float operated latch.

DETAILED DESCRIPTION

Figure 1:
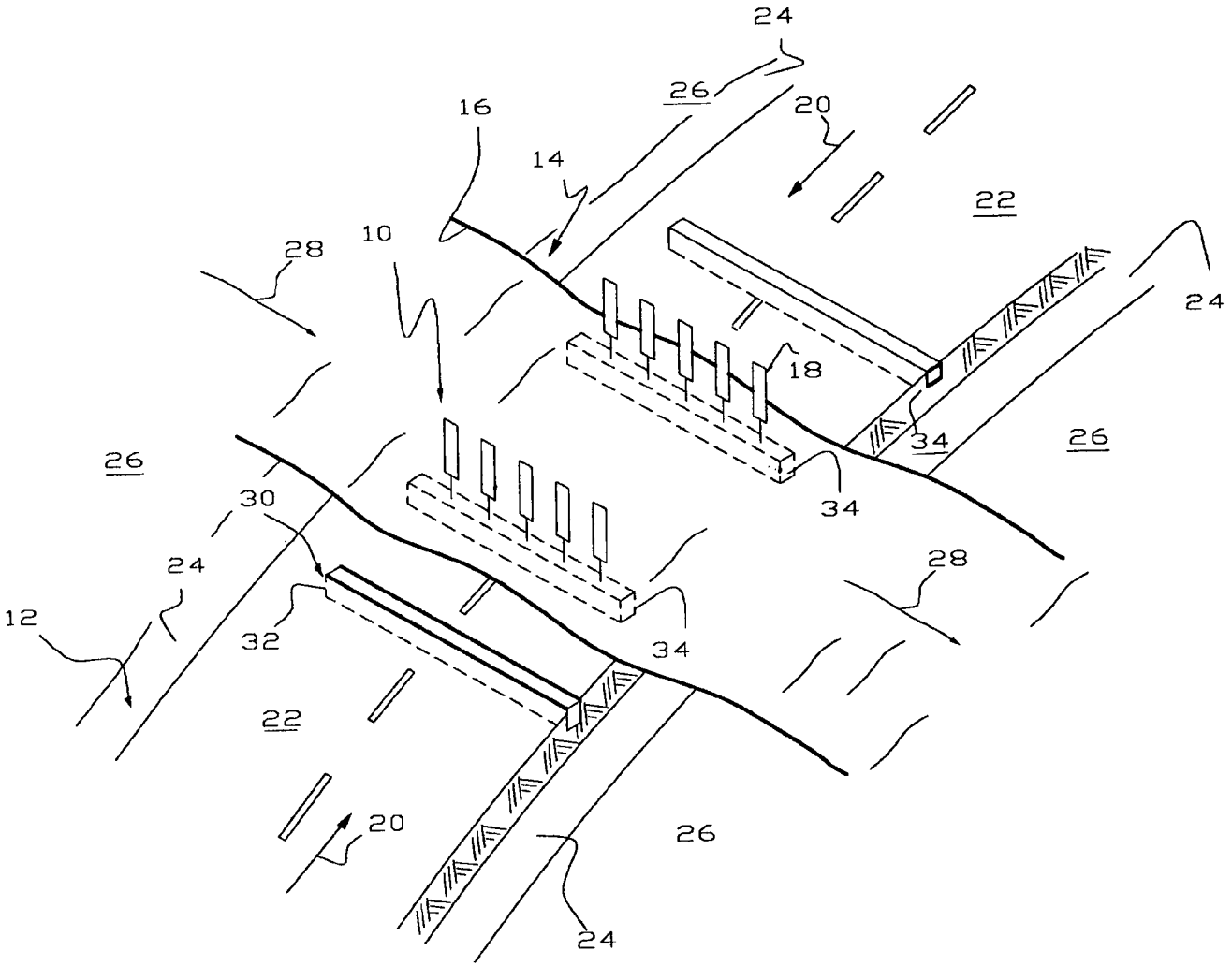
FIG. 1 is a pictorial view of a low water crossing showing a series of barricades extending in the direction of travel.

Referring to FIGS. 1–5, there is illustrated a barricade 10 which is placed across a road 12 adjacent a low water crossing 14 created by a dry creek or drainage path 16 intersecting the road 12. The barricade 10 acts in response to rising flood water to raise a series of barricade elements 18 to deter motorists from driving in a direction of travel 20 along the road 10. The barricade elements 18 are preferably made of a resilient material or of an injection molded polymer to prevent damage to vehicles striking the elements 18.

As used herein, the word road is intended to be sufficiently broad to include (1) the traffic surface 22, (2) the traffic surface 22 and a shoulder 24 and/or (3) the traffic surface 22, the shoulder 24 and all or part of the right-of-way 26. As a practical matter, the barricades 10 of this invention will generally extend only across all or part of the traffic surface 22 and perhaps all or part of the shoulder 24, depending on local conditions such as whether the shoulder 24 is paved, the slope of the shoulder 24 and the like. The traffic surface 22 may, of course, be asphalt, concrete, gravel, caliche or other suitable road materials. The direction of water movement 28 is transverse to the travel direction 20 and typically is perpendicular to the travel direction 20.

The barricade 10 includes a trench 30 extending across the road 12. To minimize flood borne debris from entering, the trench 30 includes a closed end 32 on the upstream side of the road 12 and an open end 34 on the downstream side of the road 12. Rising water accordingly enters the trench 30 from the downstream side of the road 12 so most flood borne debris goes past the entrance to the open end 34 of the trench. The trench 30 is lined with concrete 36 to provide an open top receptacle 38 for receiving the movable components of the barricade 10.

The top of the trench 30 is spanned by a cover or grate 40 allowing vehicle traffic over the trench 30 in normal weather. The grate 40 is of lattice work construction allowing water flow into the trench 30 and also provides a series of long slots 42, 44 allowing the barricade elements 18 to move from a stowed position in the receptacle 38 below the traffic surface 22 to an upright position blocking the road 12. The slots 42, 44 are staggered or offset in the direction of travel 20 so the barricade elements 18 may be spaced closely enough to prevent a vehicle from travelling between them and may be sufficiently long to extend substantially out of the water even though it may be several feet deep. Although the barricade elements may be of any suitable length, a typical barricade element 18 in the elevated position extends 3–5' above the traffic surface 22.

The barricade elements 18 are sufficiently strong and intimidating in an upright position that no reasonable motorist will be tempted to drive over them. The barricade elements 18 are sufficiently light to be raised by any suitable mechanism which is simple, inexpensive, relatively maintenance free and durable. The barricade elements 18 are spaced apart transverse to the direction of travel 20 so they may be light but are close enough together to prevent vehicle travel between them. Although the barricade elements 18 are preferably mounted for independent movement, they may be tethered together to provide an additional visual or physical obstruction. It will be seen that the barricade elements 18 do not deter movement of water between them so the barricade 10 is permeable to water.

To these ends, the barricade elements 18 are each pivotally mounted in the receptacle 38 by a suitable bracket 46 and pivot pin 48. The barricade element 18 includes a rod or elongate element 50 on which is mounted a float 52 of suitable size and buoyancy. The bracket 46 is slightly askew and a suitable stop 53 is positioned so the element 18 is tilted slightly so, when the float 52 subsides, the element 18 always falls in the correct direction. The upper end 54 of the barricade element 18 is preferably enlarged and provides suitable reflective markings 56 visible from a great distance. It will be seen that the float 52 may be connected to the barricade element 18 or may slide on the rod 50. In any event, when water rises in the trench 30, the float 52 rises in the receptacle 38 pivoting the element 18 to an upright position. When flood water recedes, water drains from the trench 30, causing the float 52 to subside and the element 18 to lie back into the trench 30.

If the low water crossing 14 is a situation where water rises substantially, one or more additional barricades 10 may be installed across the road 12 at increasing elevations away from the crossing 14, all as shown in FIG. 1. The vertical distance between successive barricades 10 is selected to be less than the height of the barricade elements 18 above the traffic surface 22. For example, if the barricade elements 18 extend four feet above the traffic surface 22, the adjacent barricades 10 will typically be installed at elevation differences of two feet so that at least two feet of the barricade elements 18 will extend above the water in any situation.

Figure 2:
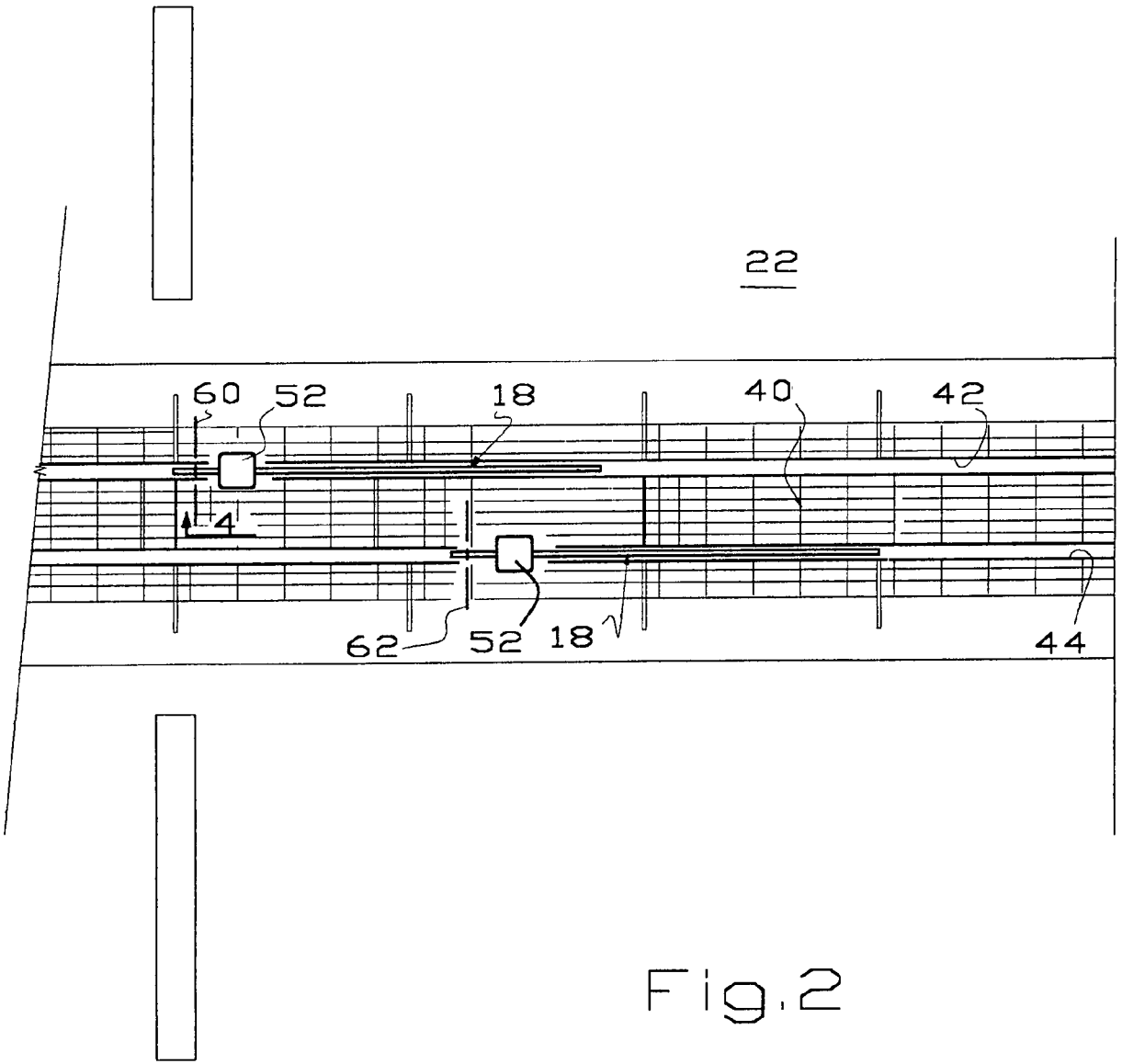
FIG. 2 is a top view of part of the trench and grate.
Figure 3:
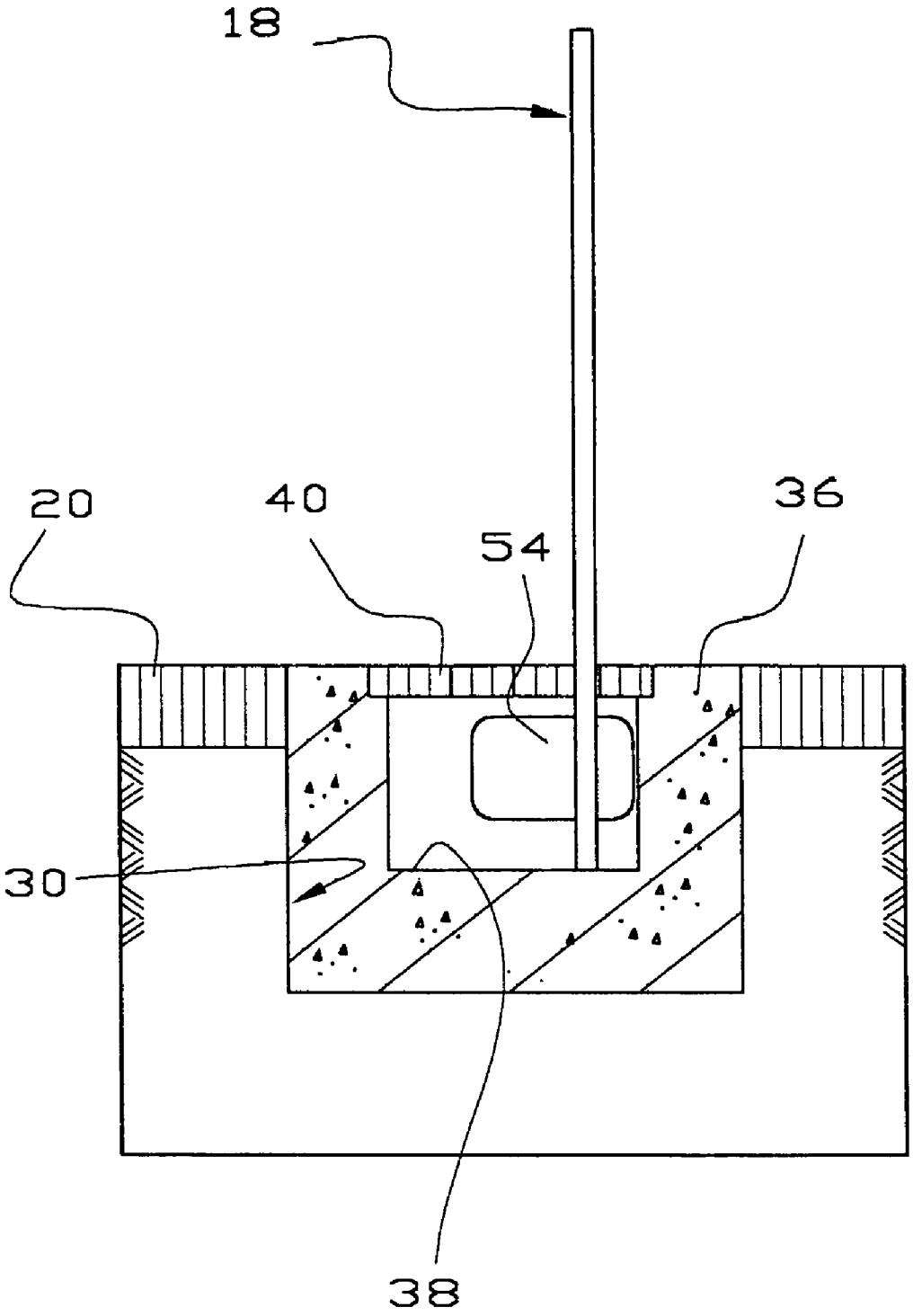
FIG. 3 is a cross-sectional view of FIG. 2, taken substantially along line 3—3 thereof, as viewed in the direction indicated by the arrows, showing only one barricade element in an upright position.
Figure 4:
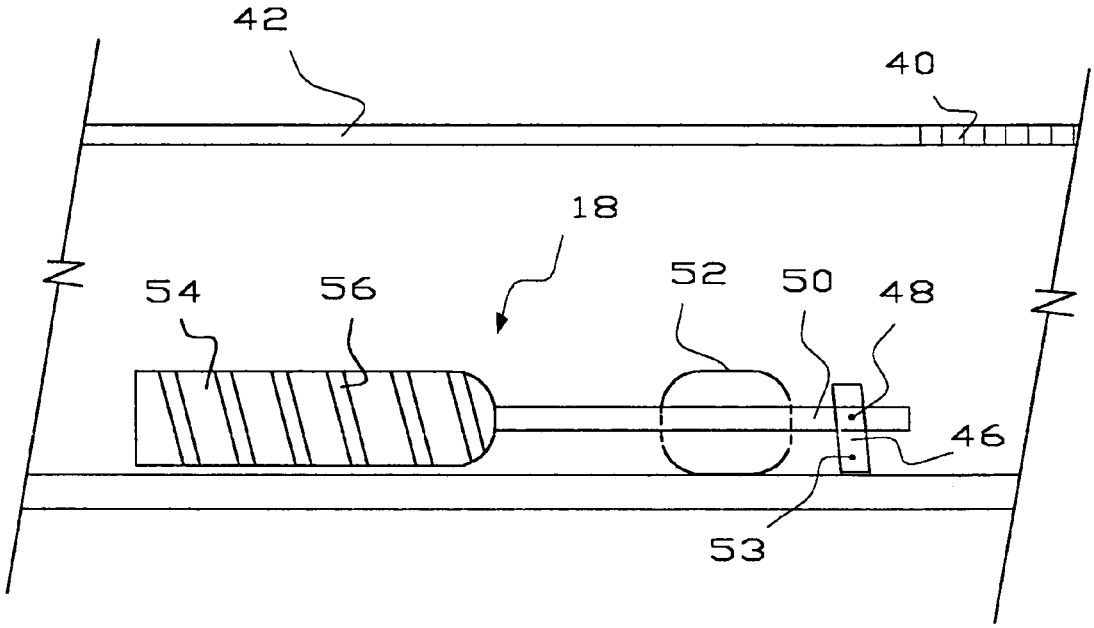
FIG. 4 is a cross-sectional view of the FIG. 2, taken along line 4—4 thereof, as viewed in the direction indicate by the arrows, showing the barricade element in the stowed position.

Referring to FIG. 2, there is illustrated another feature of this invention. The upper elements 18 rotate about axes 60 while the lower elements 18 rotate about axes 62. Thus, from the motorists viewpoint, the spacing between the upright barricade elements 18 is the distance from one of the axes 62 to the nearest axis 60. An important feature of this invention is that the barricade elements 18 rotate, during movement from the stowed position in the trench 30 toward the upright position, in the same direction as the water flow direction 28. The reason is that water flow will tend to keep the elements 18 upright. If the barricade elements 18 were pivoted in the opposite direction, water flow would tend to push them down and water flow of sufficient velocity would submerge them, thereby rendering the barricade elements 18 ineffective.

Referring to FIG. 5 there is illustrated another feature of this invention. The illustration in FIG. 5 assumes the trench 30 extends to the edge of the traffic surface 22 or to the edge of a paved shoulder 24. The outside edge of the open end 34 of the trench 30 is accordingly inclined to match the slope on the edge of the road. In the event there is a potential for traffic outside the grate 40, a suitable supplemental grate 66 may be provided as shown in FIG. 5 where an alternative construction of the trench 30 is shown to be lined with pre-cast concrete elements providing a structural box.

Installation and use of the automatic barricade 10 of this invention should now be apparent. The desired depth of the trench 30 is established by design, based on the desired depth of water over the road sufficient to raise the barricade elements 18. Using suitable surveying instruments, the depth of the trench 30 on the ground is located. A concrete saw (not shown) or other suitable device is used to cut the traffic surface 22 and a back hoe or other equipment is used to evacuate a ditch to receive the concrete lining 36 of the trench 30. The concrete lining 36 may be poured on site or may comprise a pre-cast unit placed in the ditch. The brackets 46 are positioned in the trench 30 and the barricade elements 18 and floats 54 are installed.

There is always a problem maintaining outdoor equipment analogous to this invention. This invention, however, is relatively simple to maintain. Once or twice a year, a water truck drives to the low water crossing equipped with this invention and discharges into the trench 30 a volume of water ten-fifty times the volume of the trench. The water will run out of the open trench end 34 carrying with it any debris in the trench. This and an inspection of the working components of the invention and repair of any broken components will suffice.

The barricade elements 18 of any particular installation are designed to be upright at a predetermined water depth over the road 12. With a simple pivoted barricade element 18 and float 52, the barricade element 18 tends to rise up through the grate 40 before the full water depth is reached. In many installations, this is not material because when flood waters rise, they rise so fast that the interval between the time the barricade element 18 starts to rise and when it is fully upright is very short, e.g. a few minutes. In other installations where water rise is not historically so fast, it may be desirable to keep the barricade elements 18 below the grate 40 until the water over the road 12 reaches the predetermined design depth. In this event, a float operated latch 68 of any suitable type having a retractable element 70 may be provided to prevent movement of the barricade element 18 past the grate 40 until the water over the road 12 has reached its predetermined design depth.

Referring to FIG. 6, there is illustrated a more sophisticated float operated latch 70 incorporated into a bracket 72 pivotally mounting a rod or barricade element 74 for rotation about an axis 76. To this end, the bracket 72 comprises a pair of L-shaped members 78, 80 secured to the concrete lining 82 of a trench 84 by suitable fasteners (not shown). A pivot pin 86 mounts the barricade rod 74 for rotation and a stop 88 between the bracket members 78, 80 prevents overrotation of the barricade rod 74. As so far described, the barricade element 74 operates in the same manner as the barricade element 18.

The float operated latch 70 includes a float 90 located below the top of the trench 84, a rod 92 fixed to a crank arm or offset section 94 and a stop 96 fixed to the crank arm 94. The crank arm 94 is mounted on the bracket 80 by a pin 98 for rotation about an axis 100. The stop 96 extends through an arcuate slot 102 to underlie the end 104 of the barricade rod 74 in the normal towed position of the barricade rod 74. A pair of stops 106, 108 on the bracket member 80 control the limits of rotation of the float rod 92. When no flood water is in the trench 84, the barricade rod 74 is more-or-less horizontal and the float rod 92 abuts the stop 106 as shown in FIG. 6. When flood water rises in the trench 84, a float (not shown) on the barricade rod 74 provides a force tending to rotate the rod 74 in a counterclockwise direction so the rod end 104 abuts the stop 96 thereby preventing upward movement of the barricade rod 74 until the float 90 moves. When flood water rises in the trench 84, the float 90 pivots toward the stop 108. When the float 90 rotates a sufficient distance, the stop 96 moves through the arcuate slot 102 a sufficient distance to move off the rod end 104 thereby allowing the barricade rod 74 to rotate upwardly in a counterclockwise direction to raise the barricade element abruptly, rather than gradually as would occur without the float operated latch 70.

FIG. 6 also shows another important feature of this invention. During receding of flood waters, it is desired that the barricade elements remain upright until water level subsides to a safe predetermined level and then abruptly fall back through the slots in the grate 109 into the trench 84. It is accordingly desirable to provide a float operated latch 110 holding the barricade rod 74 in an upright traffic blocking position until flood waters recede to a safe level at which time the barricade elements 74 abruptly move to their stowed position inside the trench 84. To this end, the latch 110 includes a pair of somewhat inclined slots 112, 114 aligned in the bracket members 78, 80. A stop 116 extends through the slots 112, 114 and is made buoyant in any suitable manner. The simplest construction of the stop 116 is a hollow buoyant cylinder provided with a suitable keeper (not shown) so it freely rises and falls in the slots 112, 114 in response to rising and falling water levels in the trench 84 but does not move axially out of the slots 112, 114.

When the barricade element 74 is buoyed to its upright traffic blocking position, the stop 116 has risen to the top of the slots 112, 114. When water starts to recede, the barricade rod 74 rotates clockwise and moves away from its stop 88 against the buoyant stop 116. As flood water continues to recede, the rod 74 applies an increasing force to the buoyant stop 116. Ultimately, the stop 116 falls in the slots 112, 114 due to the applied weight of the rod 74, due to movement of the stop 116 caused by the subsiding water level acting on the stop 116 or a combination of both. This allows the barricade rod 74 to abruptly rotate in a clockwise direction to its stowed position inside the trench 84.

If the trenches 30 were located at the lowest spot in the road 12, the floats 52, 90, 116 would act too early and the barricade elements 18, 74 would rise when the water level reached the lowest spot in the road. Thus, the trenches 30, 84 are located above the lowest spot in the road 12 by a distance sufficient to raise the barricade elements 18, 74 at a time when water rises a dangerous distance above the lowest spot in the road 12.

Figure 7:
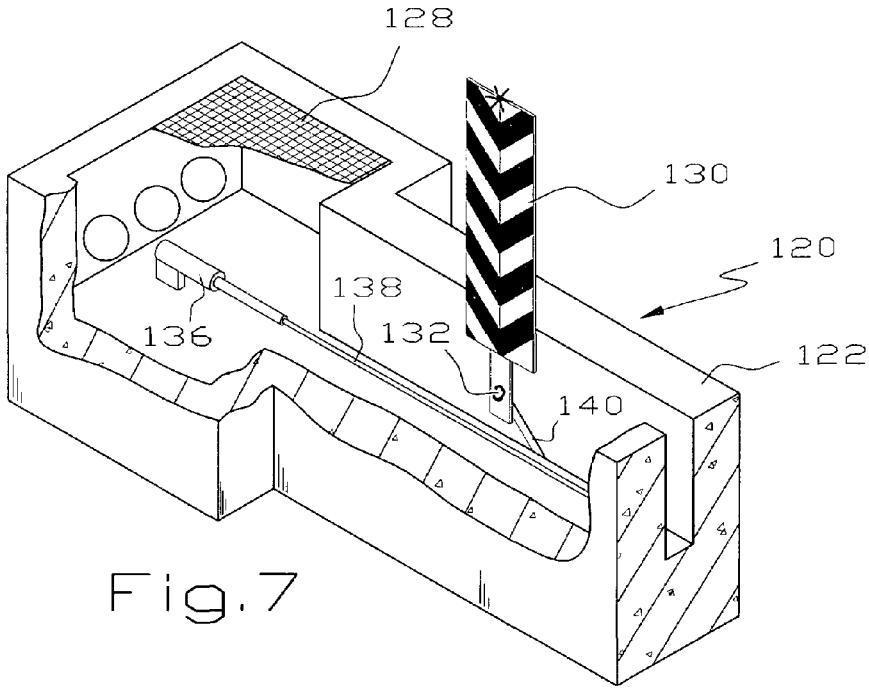
FIG. 7 is a broken isometric view showing another embodiment of this invention.
Figure 8:
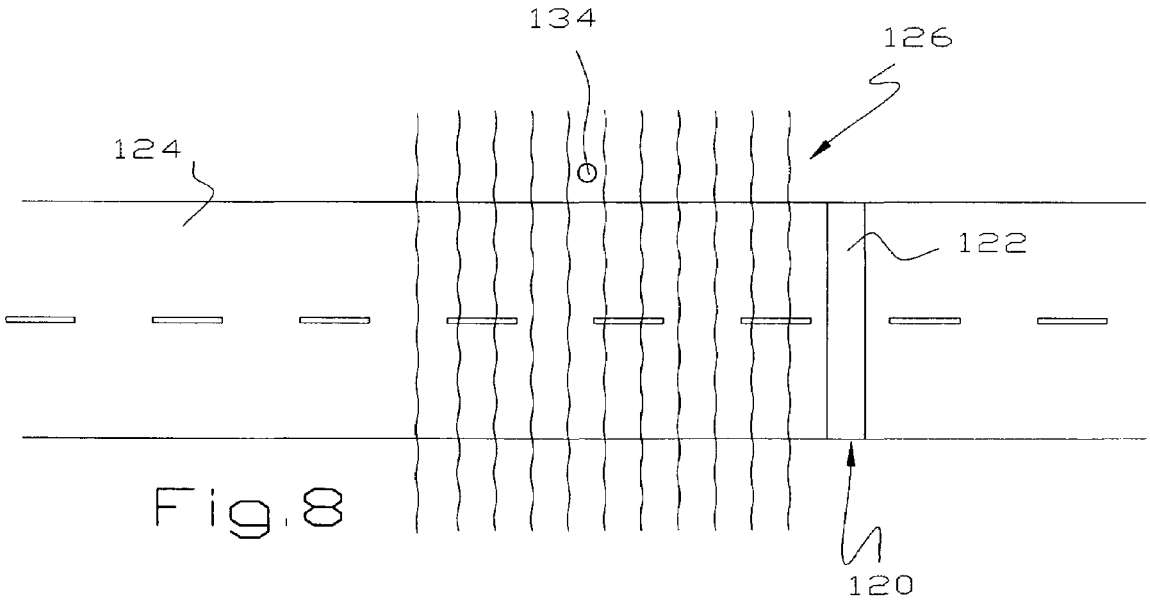
FIG. 8 is a plan view of the embodiment of FIG. 7.

Referring to FIGS. 7 and 8, there is illustrated another embodiment 120 of this invention comprising a concrete lined trench 122 extending across the road 124 at or adjacent the low water crossing 126. A grate 128 covers the trench 122 and provides slots transverse to the direction of vehicle travel for allowing a barricade element 130 to move between a generally horizontal stowed position in the trench 122 and an upright position blocking traffic along the road. The barricade element 130 is conveniently pivoted by a pin 132.

A sensor 134 is located to sense rising water in the crossing 126 and is equipped with a suitable communication link (not shown), such as a wire, radio link or the like, to energize a mechanism 136 to raise the barricade element 130 in response to rising water. Preferably, the sensor 134 is located in the trench 122 or in such close proximity to the trench 122 that the barricade elements 130 are not raised until dangerous conditions are more-or-less imminent. As used herein, the term adjacent the trench means inside or in close proximity to the trench.

The mechanism 136 may be of any suitable type, such as an electric hydraulic motor driven by a suitable power source, such as a connection to the power grid, a solar panel or the like. The mechanism 136 is connected in any suitable manner to the barricade element 130, such as by a drive connection 138 connected to a link 140 rigid with the barricade element 130. It will accordingly be seen that energizing the motor 136 rotates the barricade element 130 for an arc sufficient to raise the barricade element 130 upwardly out of the trench 122 into a traffic blocking position.

It will be apparent that the principles of this invention are equally applicable to other road structures, such as bridges, which are occasionally inundated by flood water, although the details of construction may have to be modified to take into account the construction of bridges or other road structures.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A barricade in a road transverse to a normal traffic direction and intersecting a drainage path at a low water crossing, comprising a trench in the road extending transverse to the traffic direction, a cover spanning the trench and allowing vehicle traffic on the road during dry weather, a series of barricade elements in the trench providing, in an operative position, a physical barrier blocking movement of a vehicle across the trench and, in the operative position, extending at least a plurality of feet above the road and a system for raising the barricade elements from the trench into a position blocking vehicle traffic on the road in the normal traffic direction, the barricade elements being spaced apart in the traffic blocking position so the barricade is permeable to water, the barricade raising system including a first mechanism responsive to rising water adjacent the trench and a second mechanism responsive to the first mechanism for raising the barricade elements significantly above water level.

2. The barricade of claim 1 wherein the cover provides slots therethrough, the barricade elements being stowed in a position transverse to the normal traffic direction and being movable through the slots during movement to the position blocking vehicle traffic.

3. The barricade of claim 1 wherein the road rises away from the low water crossing through a series of increasing elevations, wherein the first mentioned barricade is at a first elevation and further comprising a second barricade at a second higher elevation in the road transverse to the normal traffic direction, the first and second barricades being on opposite sides of the low water crossing, the second barricade comprising a second trench in the road, a second cover spanning the second trench and allowing vehicle traffic on the road during normal dry weather, a second series of barricade elements in the second trench providing, in an operative position, a physical barrier blocking movement of a vehicle across the second barricade elements and, in the operative position, extending on the order of several feet above the road and a second system for raising the second barricade elements from the second trench into a position blocking vehicle traffic on the road in the normal traffic direction.

4. The barricade of claim 1 wherein the first mechanism comprises a float in the trench at a location acted upon by rising water and the second mechanism comprises a linkage connecting the float and the barricade elements for elevating the barricade elements above the road when the rising water reaches a predetermined elevation.

5. The barricade of claim 1 wherein the barricade elements are in the trench staggered in the direction of travel.

6. The barricade of claim 5 wherein the barricade elements are in the trench staggered transverse to the direction of travel.

7. The barricade of claim 1 wherein the barricade elements are in the trench staggered transverse to the direction of travel.

8. The barricade of claim 1 wherein the first mechanism comprises a sensor adjacent the trench at a location acted upon by rising water and the second mechanism comprises a motor for raising the barricade elements and a communication link connecting the float and the motor for elevating the barricade elements above the road when the rising water reaches a predetermined elevation.

9. The barricade of claim 1 wherein the low water crossing includes a drainage path providing a direction of water movement, the barricade elements being mounted for arcuate movement from a stowed position in the trench toward an upright position blocking traffic, the direction of movement of the barricade elements between the stowed position and the upright position being the same as the direction of water movement.

10. The barricade of claim 1 wherein the first mechanism comprises a system operating in response to rising water and including a latch for holding the barricade elements below the road and the second mechanism comprises an operator for moving the latch in response to rising water over the road thereby allowing the barricade elements to move abruptly from a stowed position under the road to the traffic blocking position.

11. The barricade of claim 1 further comprising a latch for holding the barricade elements in the traffic blocking position and an operator for moving the latch in response to subsiding water over the road thereby holding the barricade elements in the traffic blocking position and then allowing the barricade elements to move abruptly from the traffic blocking position to a stowed position below the road.

12. The barricade of claim 1 wherein the drainage path crosses the road at a lowest spot in the road and wherein the trench is at a location above the lowest spot in the road.

13. A barricade assembly for placement in a trench in a road transverse to a normal traffic direction and adjacent a low water crossing, comprising a cover for spanning the trench, a series of barricade elements for placement in the trench and providing, in an operative position, a physical barrier for blocking movement of a vehicle across the trench, the barricade elements, in the operative position, extending on the order of several feet above the road and a system for raising the barricade elements from the trench into a position blocking vehicle traffic on the road in the normal traffic direction, the barricade elements being spaced apart in the traffic blocking position so the barricade is permeable to water, the barricade raising system including a first mechanism responsive to rising water adjacent the trench and a second mechanism responsive to the first mechanism for raising the barricade elements a significant distance above water level.

14. The barricade assembly of claim 13 wherein the cover provides slots therethrough, the barricade elements being stowed in a position transverse to the normal traffic direction and being movable through the slots during movement to the position blocking vehicle traffic.

15. The barricade assembly of claim 14 wherein the barricade elements are staggered in the direction of travel.

16. The barricade assembly of claim 14 wherein the barricade elements are staggered transverse to the direction of travel.

17. The barricade of claim 14 wherein the first mechanism comprises a float in the trench at a location acted upon by rising water and the second mechanism comprises a linkage connecting the float and the barricade elements for elevating the barricade elements above the road when the rising water reaches a predetermined elevation.

18. The barricade of claim 14 wherein the first mechanism comprises a sensor adjacent the trench at a location acted upon by rising water and the second mechanism comprises a motor for raising the barricade elements and a communication link connecting the float and the motor for elevating the barricade elements above the road when the rising water reaches a predetermined elevation.

19. A barricade in a road transverse to a normal traffic direction and intersecting a drainage path at a low water crossing, comprising a trench in the road extending transverse to the traffic direction;

a cover, providing slots transverse to the normal traffic direction, spanning the trench and allowing vehicle traffic on the road during dry weather;

a series of barricade elements in the trench providing, in an upright operative position, a physical barrier blocking movement of a vehicle across the trench and, in the operative position, extending at least a plurality of feet above the road, the barricade elements being mounted for movement between a stowed position in the trench transverse to the normal traffic direction through the slotted cover to the upright operative position; and a system for raising the barricade elements from the trench into a position a significant distance above water level thereby blocking vehicle traffic on the road in the normal traffic direction, the system including a first mechanism responsive to rising water adjacent the trench and a second mechanism responsive to the first mechanism for raising the barricade elements;

the barricade elements being spaced apart in the traffic blocking position so the barricade is permeable to water.

* * * * *